United States Patent [19]

Asa et al.

[11] Patent Number: 4,917,274

[45] Date of Patent: Apr. 17, 1990

[54] MINISCULE DROPLET DISPENSER TIP

[76] Inventors: Maurice Asa, 3046 Telegraph, Berkeley, Calif. 94705; David T. Asa, 2437 Piedmont #302, Berkeley, Calif. 94704

[21] Appl. No.: 652,750

[22] Filed: Sep. 19, 1984

Related U.S. Application Data

[63] Continuation-in-part of Ser. No. 536,946, Sep. 27, 1983, abandoned.

[51] Int. Cl.[4] ..... B65D 47/18

[52] U.S. Cl. ..... 222/420; 604/295; 604/299

[58] Field of Search ..... 222/420, 566; 604/295, 604/299

[56] References Cited

U.S. PATENT DOCUMENTS

D. 300,561 4/1989 Asa et al. ..... D24/55
2,269,823 1/1942 Kreiselman .
2,656,070 10/1953 Linder ..... 222/420 X
2,673,661 3/1954 Barton ..... 604/295 X

FOREIGN PATENT DOCUMENTS 207154 2/1984 German Democratic Rep. .

OTHER PUBLICATIONS

Tridak, Inc., Danbury, CT, "Model 260/220 Metering-/Dispense System with Automatic Positioning" (product Information brochure), pp. 2, 7, 11.

*Primary Examiner*—Kevin P. Shaver
*Assistant Examiner*—David H. Bollinger

[57] ABSTRACT

An improved miniscule fluid volume dispenser tip including a tube having an elongated constant diameter small bore disposed at the outlet end thereof with a fluid reservoir disposed at the opposite internal end thereof, the outlet end of the dispenser tip being sharply cut away to reduce surface area to which the dispensed liquid may be attach.

6 Claims, 1 Drawing Sheet

MINISCULE DROPLET DISPENSER TIP

CROSS REFERENCE TO RELATED APPLICATION

The present application is a continuation-in-part to U.S. patent application Ser. No. 06/536,946 filed Sept. 27, 1983, for Miniscule Droplet Dispenser Tip, now abandoned.

BACKGROUND OF THE INVENTION

Field of the Invention

The present invention relates to fluid miniscule volume dispensers and more particularly to a air displacement micropipette dispenser tip for dispensing volumes of fluid whereby very accurate dispensations of less than 5 microliters can be achieved.

Description of the Prior Art

There have been many types of fluid fluid volume dispenser tips employed in the past and many have been designed for the purpose of attempting to transfere accurately measured small amounts of liquid. Some are positive displacement micropipettes utilizing plungers to squeeze out the desired amount of fluid. The problem with those devices is that they are expensive to manufacture and as a result must be reuseable, and when reused, offer the risk of contamination because the fluid transferred is in direct contact with the plunger. Air displacement micropipettes on the other hand contain the fluid to be transferred wholly in the tip with an air volume interfacing between the plunger and the fluid.

One of the primary problems encountered with dispensing small amounts of fluid occur as a result of the physical phenomena of capillary action and surface tension. Alone or in combination these two phenomena (if they can be differentiated) cause the fluid being forced out of the dispenser tip to enlarge in size until it is of a weight to overcome the cohesive force of the surface tension of the liquid to separate from the dispenser. This droplet size is dependant upon many factors and is often larger than the amount of liquid desired to be dispensed. Various attempts have been made to design dispensing tips which cause small drops to separate off the end of the tip of the dispenser but largely without a great deal of success. The reason this is important is that in dispensing a volume of fluid, a droplet usually remains on the tip of the dispenser. The present invention solves the problem and causes very small droplets to be formed.

SUMMARY OF THE INVENTION

The present invention is an improved miniscule fluid volume dispenser tip which is actuated by a volume of air. It comprises an elongated tube with the dispensing end of the tube having a constant diameter small bore between 0.3 mm and 1.0 mm which extends for approximately one-fourth of the length of the tube. The dispensing end of the body of the tube surrounding the constant diameter bore terminates (at the discharge opening) with a sharp acute angle to reduce the material around the dispensing tip. The opposite end of the tube had an increased diameter internal bore with a diameter substantially greater than the constant diameter bore. The larger bore portion of the tube acts as a reservoir for the storage of the fluid to be dispensed through the tip. The fluid is forced out of the tip by an accurately controlled air displacement dispenser disposed behind the fluid reservoir. The tip is secured to the air dispenser.

OBJECTS OF THE INVENTION

It is therefore an important object of the present invention to provide an improved miniscule fluid volume dispenser tip which permits precise dispensing of accurately measured small amounts of fluid.

It is another object of the present invention to provide a miniscule fluid volume dispenser tip which can be manufactured inexpensively by high-speed injection molding processes for producing disposable dispenser tips.

It is a further object of the present invention to provide a dispenser tip which forms the smallest possible droplets relative to the size of the discharge opening in the tip.

It is still another object of the present invention to provide a dispenser tip which can dispense deep into a small container through the smallest possible opening.

It is yet a further object of the present invention to provide a dispensing tip having an external taper of approximately 10° at the end thereof to reduce the material surrounding the top to lessen the surface tension in the fluids being dispensed through the tip.

Other objects of the invention will become apparent when the preferred embodiment of the invention is considered in conjunction with the accompanying drawings.

DESCRIPTION OF THE PREFERRED EMBODIMENT

Figure 1:
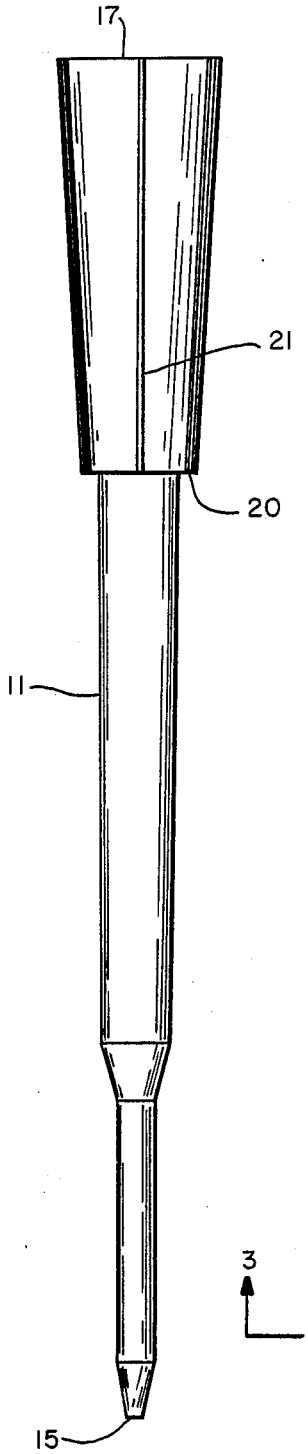
FIG. 1 is a side elevation of the miniscule fluid volume dispenser tip of the present invention.
Figure 2:
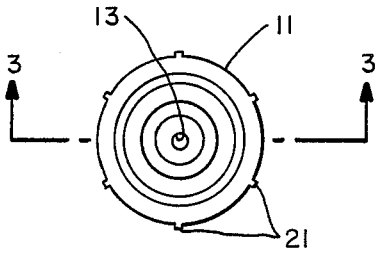
FIG. 2 is an end elevation of FIG. 1.
Figure 3:
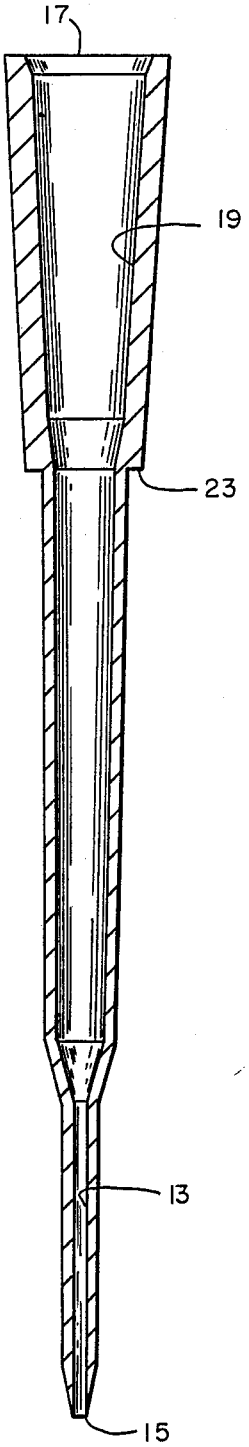
FIG. 3 is a side elevation in section taken along lines 3—3 of FIG. 2.

The present invention is a miniscule fluid volume dispenser tip which is basically comprised of an elongated tapering tube 11. One end of the tube has a constant diameter small bore 13 which extends for approximately one-quarter of the length of the tube. The term "small bore" is measured in relation to the size of a fluid droplet which would dispense out of the end of an ordinary glass eye-dropper which in the case of water, or a water based fluid, could be in some instances greater than one eighth of an inch in diameter.

The dispenser of the present invention is especially adapted for accurate dispensing of volumes of fluid as small as 0.5 microliters in size. The small bore is between 0.3 and 1.0 mm. in diameter with the optimum for water being approximately 0.6 mm. The length of the dispenser tip is approximately 6.5 cm. with the constant diameter bore being approximately 1.5 cm. long. The variation in length and diameter of bore depends upon the type of fluid to be utilized in the dispenser with smaller diameters and shorter lengths being used for more volatile low-density fluids which have lower coefficients of surface tension while the larger bores and longer lengths are associated with less volatile higher surface tension fluids.

The body of the tube which surrounds the constant diameter bore has a generally constant external diameter portion adjacent a tapered portion at the dispensing tip 15. There seems to be a correlation between a minimum amount of material disposed at the tip of the dispenser with the least amount of affinity for the tip by the fluid being dispensed. Thus, the tapered tip reduces the amount of material surrounding the discharge opening to which the fluid being dispensed can adhere. As a result, the droplets that adhere are of the smallest size possible. The smaller the droplet, the more accurately a fluid can be measured or dispensed. A 10° taper has been found to be optimum from a strength in the tip versus minimum material correlation.

The opposite end of the tube 17 from the dispensing tip 15 has an increased size which is substantially greater than the constant diameter bore portion of the tip. The increased diameter internal bore provides a fluid reservoir for storage of the fluid which is to be dispensed through the constant bore portion of the tip. In the preferred embodiment, this larger internal bore decreases in diameter toward the transition from large bore to constant bore 13 such that it has a tapering internal bore with relatively constant thickness sidewalls.

A tapered outer configuration has the disadvantage in translucent materials of making the level of clear fluids in the tube hard to see, so a constant diameter external configuration in the constant bore portion of the tube is preferable. However, with the sizes involved and the plastics available, a thin wall constant diameter tube of very much length does not have the strength to remain straight after it is molded, so a tapered configuration in the fluid reservoir portion of the tip connected to a short straight base portion is a compromise necessary for the present materials available. The larger end of the tube is approximately 0.7 cm in external diameter while the dispenser tip is approximately 1.8 mm in external diameter.

This tapered internal and external configuration also aids in the manufacture of the tip. The external configuration of the preferred embodiment of the dispenser includes longitudinal ribs 21 disposed about the external surface of the large end of the tube.

It has been found that this configuration of dispenser tip, for whatever physical reason, in operation appears to permits minute fluid volume dispensing from the tip and is a configuration which can be readily manufactured by high-speed injection molding whereby the tips are disposable because of the low cost of manufacture.

While the preferred embodiment of the invention has been described in detail herein, the invention is not to be limited to such details as have been set forth except as may be necessitated by the appended claims.

I claim:

1. An improved fluid volume dispenser tip comprising an elongated tube, the discharge end of said tube having a constant diameter small bore between 0.3 and 1.0 mm which extends for approximately one-fourth the length of the tube, the outside diameter of the tip of the discharge end of the tube being of a constant diameter to where it is tapered at a sharp acute angle to the discharge opening to reduce the material disposed therearound, and the opposite end of said tube having an increased diameter tapered internal bore for storage of fluid and an internal diameter substantially greater than said constant bore internal diameter.

2. The fluid volume dispenser tip of claim 1 including a generally decreasing internal diameter for a portion of the length thereof tapering from the fluid storage end of said tube toward the portion of said tube containing said constant diameter bore, the taper of said tip being approximately a 10° taper.

3. An improved fluid volume dispenser tip comprising:

an elongated tube, one end of said tube having a constant diameter bore portion which extends for approximately one-fourth the length of said tube, said bore being approximately 0.6 mm. in diameter and 1.5 cm. in length, an outside diameter of said one end of the tip being tapered at approximately a 10° angle to reduce the material comprising the tip around an opening at said one end, the outside diameter of the remainder of the length of the constant diameter bore portion of said tip being a constant diameter, the opposite end of said tube having an increased diameter internal bore for the storage of fluid, said increased bore being substantially greater than said constant diameter bore and decreasing in diameter tapering toward the discharge end of said tube, and the body of said tube surrounding said internal bores having a generally decreasing outside diameter tapering for a portion of the length thereof from the fluid storage end of said bore to the portion of said tube containing said constant diameter bore.

4. An improved fluid volume dispenser tip comprising an elongated tube, the discharge end of said tube having a substantially constant bore with a diameter less than 1.0 mm. and extending for at least approximately one-fourth the length of the tube and defining a discharge opening in the discharge end, the outside diameter of the tip of the discharge end of the tube being of a substantially constant diameter to where it is tapered to the discharge opening to reduce the material disposed therearound, and the opposite end of said tube having an increased diameter tapered internal bore for storage of fluid and internal diameter substantially greater than said constant bore internal diameter.

5. In a pipette tip in the form of a single piece hollow shell of translucent material having a length between first and second ends thereof, said first end having an opening therein for discharging fluid therethrough in response to positive displacement of air within the shell, and said second end adapted to be connected to a micropipettor capable of creating that displacement of air, the improvement comprising:

a first segment of the length of the shell adjacent said first end and extending therefrom a significant finite length with a substantially constant inside diameter bore therein of less than one millimeter and a substantially uniform outside diameter therealong except for a portion of said first segment immediately adjacent said first end which is tapered from the uniform outside diameter toward the discharge opening at an extreme end of said constant inside diameter bore, and a second segment of the length of the shell adjacent said second end extending therefrom a significant distance and having a decreasing internal diameter opening as a function of distance away from said second end that is in fluid communication with said constant inside diameter bore.

6. The improved pipette tip according to claim 5 wherein said first segment of the shell length is at least approximately one-fourth of the length of said shell.

* * * * *